US005123152A

United States Patent [19]

Tenkula et al.

[11] Patent Number: 5,123,152

[45] Date of Patent: Jun. 23, 1992

[54] YANKEE CYLINDER WITH A PLASMA-SPRAYED CARBIDE COATING

[75] Inventors: Jaakko Tenkula, Raahe; Bjarne Hellman; Jorma Majava, both of Riihimäki, all of Finland

[73] Assignee: Tampella Telatek Oy, Raahe, Finland

[21] Appl. No.: 773,987

[22] Filed: Oct. 9, 1991

Related U.S. Application Data

[63] Continuation of Ser. No. 477,605, Feb. 9, 1990, abandoned.

[30] Foreign Application Priority Data

Feb. 16, 1989 [FI] Finland ..... 890767

[51] Int. Cl.[5] ..... B21B 31/02

[52] U.S. Cl. ..... 29/132; 427/34; 162/357

[58] Field of Search ..... 29/132; 427/34, 426; 162/111, 357

[56] References Cited

U.S. PATENT DOCUMENTS

| | | | |
|---|---|---|---|
| 4,064,608 | 12/1977 | Jaeger | 29/132 |
| 4,389,251 | 6/1983 | Simm et al. | 75/255 |
| 4,478,871 | 10/1984 | Sakaguchi et al. | 427/34 |
| 4,794,680 | 1/1989 | Meyerhoff et al. | 29/132 |
| 4,796,342 | 1/1989 | Miihkinen | 29/132 |
| 4,822,415 | 4/1989 | Dorfman et al. | 427/423 |
| 4,951,392 | 8/1990 | Miihkinen | 29/132 |

*Primary Examiner*—P. W. Echols
*Assistant Examiner*—David P. Bryant
*Attorney, Agent, or Firm*—Webb, Burden, Ziesenheim & Webb

[57] ABSTRACT

The invention relates to a Yankee cylinder for a papermaking machine, in which a coating which is a mixture of a metal powder and a carbide or nitride and withstands well the wearing effect of the doctor blade and other corrosive and thermal stresses produced in papermaking is formed on top of the cylinder mantle. The invention also relates to methods for coating a Yankee cylinder with such a coating by using a detonation, plasma or supersonic method.

4 Claims, No Drawings

YANKEE CYLINDER WITH A PLASMA-SPRAYED CARBIDE COATING

This is a continuation of copending application Ser. No. 07/477,605 filed on Feb. 9, 1990, now abandoned.

The invention relates to a Yankee cylinder for use in a paper-making machine and to coating methods used in its manufacture and repair.

The Yankee cylinders used in the paper-making process are in the main manufactured by casting from cast-iron. Cylinder mantles have also been assembled from steel sheets by welding. The largest cylinders have diameters of 6–7 m, and their length may be 5–6 m. The wall thickness of a new cylinder is 40–60 mm.

During paper-making, a so-called doctor blade, which detaches the paper from the cylinder surface and crinkles it, scrapes against the cylinder surface.

The doctor blade wears away the cylinder surface and especially the edge parts of the cylinder. For this reason the cylinder must occasionally be ground to give the cylinder surface the correct shape and a suitable surface quality.

When a cylinder has been ground many times, its wall thickness will reach the limit set by the pressure vessel authorities. The thinner the wall thickness, the more the operating pressure of the cylinder must be reduced. Reducing the operating pressure will mean a slowing down of the production rate. At this stage the Yankee cylinders are usually repaired by coating.

Another reason for the coating is that the mantle surface may have pores which produce holes in the paper. If there are few holes, they can be plugged, but small cavities in large numbers will necessitate the coating of the mantle.

Yankee cylinders have been coated for nearly 20 years. The coating materials used have included:

martensitic stainless steel (AISI 420), arc sprayed
martensitic stainless steel (AISI 431), plasma sprayed
CrNiMoAl alloy, plasma sprayed
Mo-based alloys, plasma sprayed Arc-sprayed coatings have in certain cases been a success, but in the manufacture of new paper grades and as the speeds of paper-making machines increase, they do not meet the requirements.

Plasma-sprayed coatings are considerably more resistant to corrosion, and also their resistance to wear is better than that of arc-sprayed coatings. However, both CrNiMoAl alloys and Mo-based alloys have the drawback that they wear away too rapidly when very thin papers are being made. The reason is the wearing effect of the doctor blade and the fact that flint particles from the paper stock adhere to the doctor blade during disturbances, and they "lathe" the coating.

The coatings currently known are 0.8–2.0 mm thick, so that they can be ground often enough before re-coating. A thick coating decreases the thermal conductivity of the cylinder wall, slowing down production and increasing the energy costs.

Furthermore, the present-day coatings have to be ground at approximately one-year intervals, some even at 4–6 month intervals, as the quality of the surface deteriorates. An intermediate grinding will cause a stoppage of 5–8 days, resulting in extensive production losses. Repairing the cylinder by re-coating will for its part cause a stoppage of 12–25 days.

The most extensive production losses, in addition to the above, occur when a paper-making machine cannot be used for making those paper grades for which the best prices can be obtained.

The primary object of the present invention is to provide a Yankee cylinder with such a mantle surface layer that the doctor blades wear it away very little, with an improved thermal conductivity of the mantle, and with longer intervals between its mantle maintenance sequences.

It is also an object of the invention to provide coating methods to be used in the manufacture and repairs of a Yankee cylinder; by using the methods a cylinder mantle with the above-mentioned properties is obtained.

The present invention thus relates to a Yankee cylinder for use in a paper-making machine, the cylinder having ends and axle pins, as well as a cylinder mantle which is made of metal and primarily gives the cylinder its mechanical strength, the Yankee cylinder being characterized in that on top of the cylinder mantle there is formed a coating which constitutes the surface layer and which is a mixture of metal powder and carbide or nitride and well withstands the wearing effect of the doctor blade as well as other corrosive and thermal stresses occurring in paper making.

The surface layer of a Yankee cylinder according to the invention is primarily made of a mixture of a carbide or nitride of tungsten, titanium, vanadium or boron and a powder of cobalt, nickel or iron. The surface layer preferably contains the above-mentioned carbide or nitride 60–94 weight percent and the above-mentioned metal 6–40 weight percent. The thickness of the surface layer is in the main less than 0.5 mm and preferably within 0.2–0.3 mm.

According to the invention, a Yankee cylinder can be coated so that, on top of the cylinder mantle directly or on top of a metallic coating which has first been sprayed on the cylinder mantle and constitutes an intermediate layer, there is sprayed by a detonation, plasma or supersonic method a coating which forms the surface layer and is a mixture of a metal powder and a carbide or nitride and well withstands the wearing effect of the doctor blade and other corrosive and thermal stresses occurring in paper making.

The particle size of the coating material mixture forming the surface layer is preferably 5–70 $\mu$m.

The mantle coating is made directly on the surface of a mantle made of cast-iron or steel by spraying the coating by a detonation, plasma or supersonic method, the surface having first been ground precisely to the correct dimension and shape.

According to another embodiment of the method according to the invention, the mantle surface of a Yankee cylinder is first coated with a martensitic stainless steel or a NiCrMoAl alloy or a Mo-based alloy by thermal spraying, arc spraying or plasma spraying, and is then ground precisely to the correct shape and dimension. Thereafter the surface is pre-treated by grinding or grain blasting to roughen it, and then coated by spraying, by a detonation, plasma or supersonic method, a coating which contains a carbide or nitride and a metal powder.

After coating according to either the first or the second embodiment of the invention, the mantle surface is ground. Since the wear-resistant components of the coating are carbides or nitrides of tungsten, titanium, vanadium or boron, the surface has to be ground with a diamond. Diamond grinding can be commenced as stone grinding, but the final grinding must be carried out using a diamond band in order to eliminate vibration. Furthermore, the surface quality can be superfinished using a diamond-containing liquid.

The advantages of the Yankee cylinder and coating method according to the invention over the prior art are the following:

1.0 Better resistance to wear

The carbides and nitrides present in the coating are very hard (2400–4500 HV), and they have been chosen so that adhesion between the doctor blade made of annealed steel and the carbides and nitrides is very small.

Thus the wearing away of the surface of the Yankee cylinder mantle is slight even in harsh operating conditions.

Furthermore, during disturbances in operation the hard flint particles brought to the doctor blade in the paper stock cannot wear the coating since the hardness of the flint particles (approx. 1500 HV) is considerably less than that of the coating.

The hardness of prior-art coatings is only 350–700 HV, so that flint particles will easily "lathe" grooves into the coating.

2.0 Possibility of making new paper grades

When new, very thin paper grades are being made, the doctor blade often comes into direct contact with the mantle surface, since usually the so-called coating layer between the mantle surface and the doctor blade may become removed. If the mantle surface cannot withstand such wear, it becomes scratched and causes problems in paper-making. With the new, wear-resistant coating, this problem does not appear.

The corrosion-resistance of the new coating is also very good; this enables special-purpose papers to be made in acid solutions in which the pH may be 3–5.

3.0 Energy costs will decrease

The thickness of the new coating is only 0.2–0.3 mm. The thickness of previously used coatings is 0.8–2.0 mm.

A thinner coating conducts heat better and thus reduces the energy required in the drying of paper.

4.0 The costs of stoppages and maintenance will decrease

The coatings currently in use have to be ground on average at one-year intervals. When thin paper grades are manufactured, the interval between grindings may be 4–6 months.

With the new coating, an average grinding interval of two years can be achieved. Since for a large paper-making machine one grinding will cause a stoppage of approx. 5–8 days, resulting in production losses of 5–8 million FIM, (Finnish Marks) the savings due to the longer maintenance sequence will be significant.

5.0 Time required for maintenance will shorten

The coatings currently in use are maintained by grinding the old coating off either in part or totally down to the basic material of the mantle. Thereafter the coating is renewed from the basic material up, and is ground.

By the new technology developed, the coating can be made over the old coating, once the old coating has first been pre-ground clean. The developed technology thus shortens by up to several days the time required for the maintenance.

We claim:

1. A Yankee cylinder for a paper-making machine, having ends and axle pins, as well as a cylinder mantle which is made of metal and primarily gives the cylinder its mechanical strength, characterized in that on top of the cylinder mantle a plasma or supersonic sprayed coating is formed which constitutes the surface layer, the coating being an alloy of a metal powder and a carbide or nitride and resisting well the wearing effect of a doctor blade and other corrosive and thermal stresses produced in paper making.

2. A Yankee cylinder according to claim 1, characterized in that the coating constituting the surface layer contains a carbide or nitride of tungsten, titanium, vanadium or boron 60–90 weight percent and cobalt, nickel or iron 6–40 weight percent.

3. A Yankee cylinder according to claim 1 or 2, characterized in that the thickness of the coating constituting the surface layer is less than 0.5 mm.

4. A Yankee cylinder according to claim 1 or 2, in which the thickness of the coating constituting the surface layer is 0.2–0.3 mm.

* * * * *